US008789486B2

(12) United States Patent
Boudeau et al.

(10) Patent No.: US 8,789,486 B2
(45) Date of Patent: Jul. 29, 2014

(54) BOATS HAVING INFLATABLE PLANKING

(75) Inventors: Lionel Boudeau, Paris (FR); Erwann Ravary, Palau-saverdera (ES); Marc Lavorata, Paris (FR)

(73) Assignee: Zodiac Milpro International, Paris (FR)

( * ) Notice: Subject to any disclaimer, the term of this patent is extended or adjusted under 35 U.S.C. 154(b) by 99 days.

(21) Appl. No.: 13/809,478

(22) PCT Filed: Jul. 13, 2011

(86) PCT No.: PCT/FR2011/051681

§ 371 (c)(1),
(2), (4) Date: Jan. 10, 2013

(87) PCT Pub. No.: WO2012/007694

PCT Pub. Date: Jan. 19, 2012

(65) Prior Publication Data

US 2013/0098284 A1 Apr. 25, 2013

(30) Foreign Application Priority Data

Jul. 13, 2010 (FR) ..... 10 55726

(51) Int. Cl.
*B63B 7/00* (2006.01)
*B63B 7/08* (2006.01)

(52) U.S. Cl.
CPC ..... *B63B 7/082* (2013.01)
USPC ..... 114/345

(58) Field of Classification Search
CPC ..... B63B 7/08; B63B 7/082
USPC ..... 114/345
See application file for complete search history.

(56) References Cited

U.S. PATENT DOCUMENTS

| | | | | |
|---|---|---|---|---|
| 4,348,779 | A | 9/1982 | Leber | |
| 5,584,260 | A * | 12/1996 | Hemphill | 114/345 |
| 6,453,840 | B1 * | 9/2002 | Higginbotham et al. | 114/345 |

FOREIGN PATENT DOCUMENTS

| | | |
|---|---|---|
| DE | 716 211 | 1/1942 |
| EP | 0 419 888 | 4/1991 |
| FR | 2 578 220 | 9/1986 |
| GB | 980 705 | 1/1965 |
| GB | 2 161 118 | 1/1986 |

OTHER PUBLICATIONS

International Search Report dated Dec. 12, 2011, corresponding to PCT/FR2011/051681.

* cited by examiner

*Primary Examiner* — Lars A Olson
*Assistant Examiner* — Anthony Wiest
(74) *Attorney, Agent, or Firm* — Young & Thompson

(57) ABSTRACT

A semi-rigid boat, includes a rigid hull (11) provided, at the bridge thereof (6), with two types of holders for the inflatable tube(s): a gutter-shaped holder for receiving, at the bow and/or at the stern, a section (13, 14) of tube (12) having a circular cross-section; and a planking wall-shaped holder (16) that extends between the bow and the stern, which is provided so as to engage with an inflatable section-shaped structure (15) having a D-shaped cross-section that extends longitudinally between the sections (13, 14). The section (15) of inflatable tube having a D-shaped cross-section is attached to the bottom portion and to the top portion of the planking wall (16).

8 Claims, 3 Drawing Sheets

FIG. 3
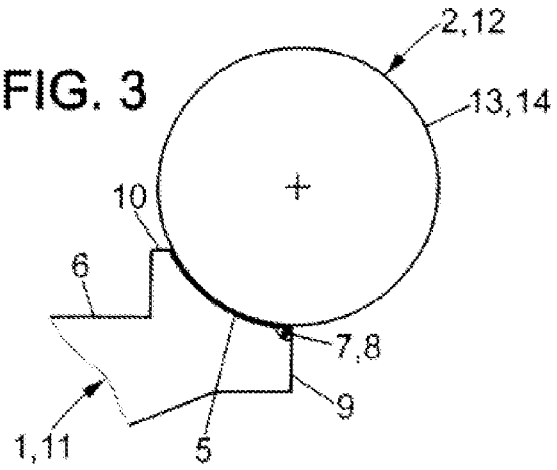
FIG. 4a
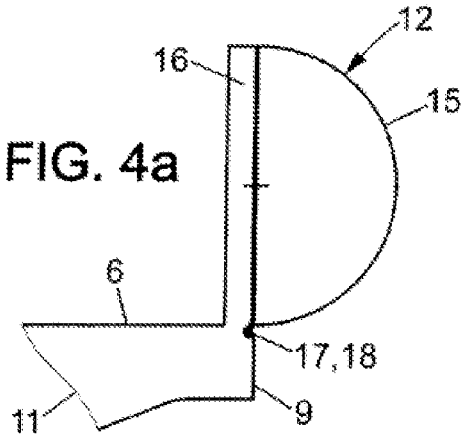
FIG. 4b
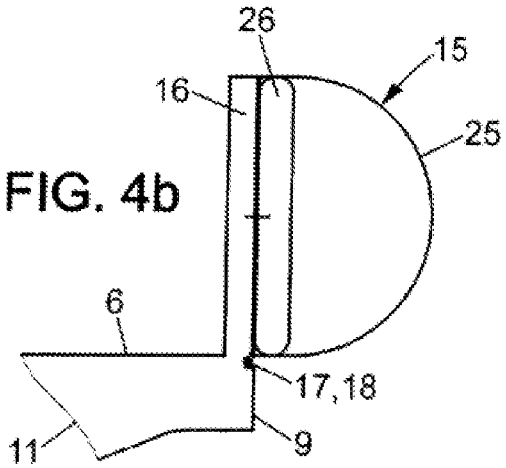
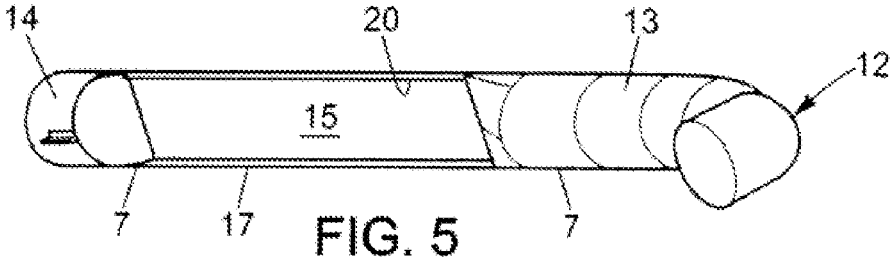
FIG. 5

BOATS HAVING INFLATABLE PLANKING

OBJECT OF THE INVENTION

The invention relates to boats that are semi-rigid, meaning boats with a hull of rigid material and an upper side wall (also referred to in this document as planking) consisting of one or more inflatable tubes.

PRIOR ART AND PROBLEMS

Semi-rigid boats combine the advantages of inflatable boats and boats with a rigid hull.

The cylindrical tubes that form the upper side wall have a circular cross-section when inflated and their diameter is approximately 50 to 60 cm, which provides very good buoyancy. The midship section in this type of boat is very large while the weight and bulk are relatively moderate when the tubes are deflated. The stability of this type of boat feels reassuring and safe to passengers. In addition, the rigid hull is protected by the presence of inflatable tubes which extend from the bow to the stern.

However, this combination of rigid hull and inflatable tubes has disadvantages which are related to the presence of the inflatable tubes.

These tubes overlap the part of the rigid hull which corresponds to the deck of the boat. The effective useful floor space on the deck is reduced accordingly.

The ratio between the usable surface area and the surface area attached to the perimeter of the boat is not as good as it is in a boat with a rigid hull.

Advantages of the Solution According to the Invention

The invention proposes an arrangement for this type of boat which substantially improves this ratio between the usable surface area and the surface area attached to the perimeter of the boat, which allows increasing the usable space inside the boat. This increase makes it easier to move about on board, or allows installing additional equipment such as seats, or allows improving motor accessibility or possibly installing larger motor(s) for boats with an in-board motor.

The invention proposes an arrangement which removes almost none of the buoyancy or safety characteristics of this type of boat, and this arrangement maintains the characteristics concerning the impact resistance of the boat both at the bow and at the stern, and even on the sides.

Solutions Provided by the Invention

The boat of the invention comprises a rigid hull associated with one or more inflatable tubes which act as upper side walls, and said rigid hull has the characteristic of comprising two types of holder for this or these tubes, at its deck:

- a gutter-shaped holder for receiving, at the bow and/or stern, a section of tube having a circular cross-section, said holder being positioned substantially at the level of the deck, cooperating with a longitudinal portion of the cylindrical envelope of said bow and/or stern section,
- a holder in the form of an upper side wall segment which extends between said bow and said stern, arranged to cooperate with a structure in the form of a section of inflatable tube which extends longitudinally between said bow and stern sections, said holder in the form of a wall segment extending to a height which substantially corresponds to the diameter of said bow and stern sections and its lateral position being such that its outer face is located substantially in the vertical mid-plane of said bow and stern sections.

In the invention, the structure in the form of a section of inflatable tube which is associated with the upper side wall segment has a D-shaped cross-section of which the flat face is applied against the outer face of said upper side wall segment and the curved face is positioned as an extension of the outer portions of the bow and stern sections.

Still according to the invention, the section having a D-shaped cross-section is attached to the lower portion and to the upper portion of the upper side wall segment.

Advantageously, the lower portion of the section having a D-shaped cross-section comprises a bolt rope which is threaded in a groove in the rigid hull, said groove being arranged in the lower portion of the upper side wall segment.

In this case, advantageously, the bolt rope located in the lower portion of the section having a D-shaped cross-section can additionally be an extension of the bolt rope of the bow and/or stern sections, and the groove accepting said bolt rope can extend for the entire length of the rigid hull.

Advantageously, the upper portion of the section having a D-shaped cross-section comprises a fabric band which is either slipped into a track, or bolted onto the upper portion of the upper side wall segment, with a metal strip placed between them.

Also advantageously, the section having a D-shaped cross-section extends, between the bow and the stern, for a length corresponding to at least half the length of the boat, with a major portion of the length of said section arranged on the stern side.

In another arrangement of the invention, the section having a D-shaped cross-section consists of a single inflatable tube, delimited by the fabric attached to the upper side wall segment and by fabric which, in the inflated state, forms an arc that is an extension of the bow and stern sections, said tube being a single tube.

In a variant embodiment of the invention, the section having a D-shaped cross-section comprises at least two inflatable volumes, one of said volumes consisting of a substantially vertical inner part with an inflatable volume of watertight cloth or fabric having two parallel faces, forming, in the inflated state, a tube shape with a substantially elongated rectangular cross-section, fixed and attached by its inner face to the outer face of the upper side wall segment, and the other of said volumes, the outer part, consisting of an inflatable tube having a D-shaped cross-section, fixed and attached by its flat face to the outer face of the two parallel faces of the inner part, meaning the outer face of the inner inflatable tube.

Additionally or alternatively, the inflatable tube or tubes is/are assembled with the upper side wall segment, to its upper portion and its lower portion, by means of flexible angle attachments, preferably of watertight fabric or cloth, glued directly to said upper side wall.

DESCRIPTION OF FIGURES ACCOMPANYING THE DESCRIPTION

The invention is detailed in a sufficiently clear and complete manner in the following description to enable its implementation. This is accompanied by drawings, in which:

FIG. 3 is a transverse cross-sectional view of a tube having a circular cross-section, arranged at the stern or the bow of the boat;

Figure 6:
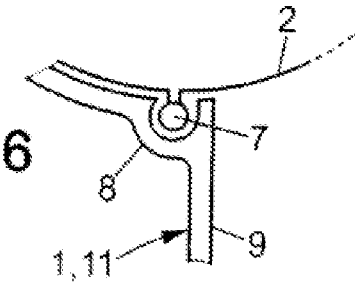
Figure 7:
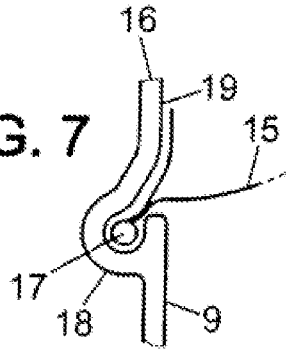
Figure 8:
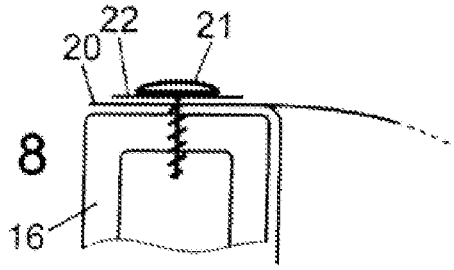

FIGS. 4*a* and 4*b* are transverse cross-sectional views of variants of the inflatable tube section having a D-shaped cross-section according to the invention: FIG. 4*a* shows a single inflatable tube with a D-shaped cross-section, attached to a wall segment acting as the upper side wall, and FIG. 4*b* shows an inner inflatable tube with a rectangular cross-section, attached to said upper side wall segment, with an outer inflatable tube having a D-shaped cross-section, attached by its flat face to the outer flat face of the inner tube;

FIG. 5 shows a perspective view of a tube according to the invention, acting as an upper side wall;

FIG. 6 shows a system for assembling the tube onto the semi-rigid hull at the cylindrical portions of said tube;

FIG. 7 shows an attachment of the lower portion of the tube section having a D-shaped cross-section, onto the rigid hull; and FIG. 8 shows an attachment of the upper portion of the tube section having a D-shaped cross-section onto the wall segment serving as an upper side wall.

DETAILED DESCRIPTION OF THE INVENTION

Figure 1:
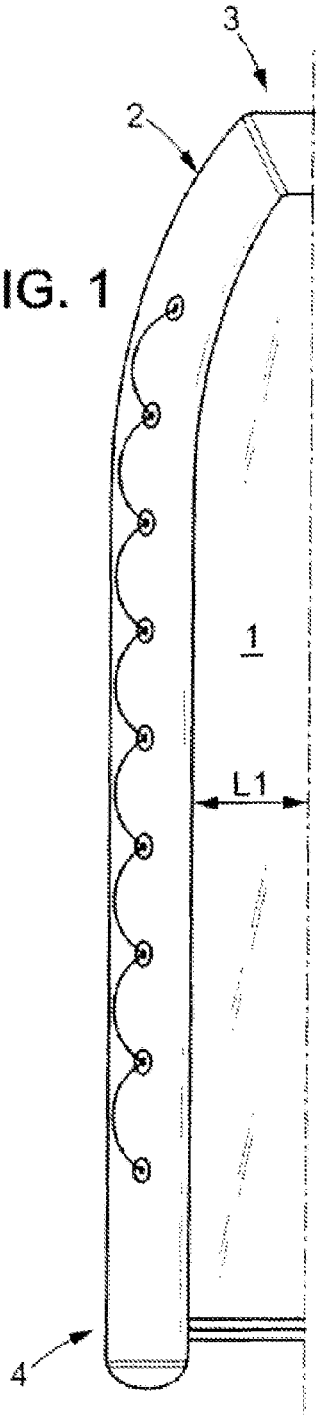
FIG. 1 is a plan view of the left half of a conventional semi-rigid boat.

The boat, or craft, represented in a schematic illustration in FIG. 1 in a half-plan view, comprises a rigid hull 1 and an upper side wall in the form of an inflatable tube 2. Said tube may possibly comprise several separately inflatable compartments.

This inflatable tube 2 extends between the bow 3 and the stern 4, and its cross-section is circular for the entire length of the upper side wall. This tube 2, as represented in FIG. 3, rests on a holder 5 in the form of a gutter which runs peripherally along the rigid hull 1, at the edge of the deck 6.

This holder 5 has a cross-section in the form of an arc in order to hold a portion of the cylindrical envelope of the tube 2, specifically a longitudinal strip along the lower portion of said tube. The tube 2 comprises a bolt rope 7 running along its length, which, as represented in FIG. 6, engages and cooperates with a guide track 8 arranged along the outer edge 9 of the rigid hull 1, at the intersection of this edge 9 and the edge of the holder 5 surface. The tube 2 can also be attached by appropriate means to the other edge of the holder 5 and in particular to the inner edge 10 located next to the deck 6 of the boat.

Figure 2:
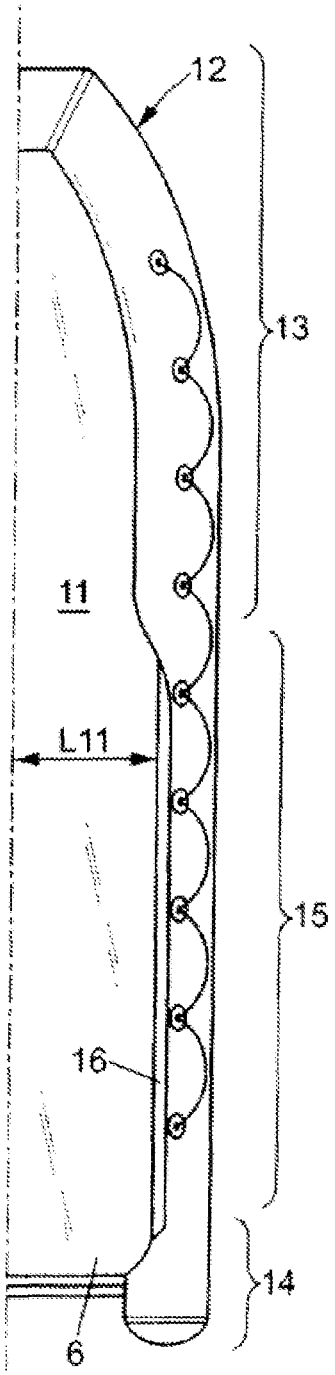
FIG. 2 is a plan view of the right half of a semi-rigid boat arranged according to the invention.

FIG. 2 shows the boat of the invention in a half-plan view. It comprises a rigid hull 11 and a tube 12 in which the cross-section changes between the bow 3 and the stern 4. The tube 12 comprises several sections which form a continuity:

- a front section 13 at the bow 3, having a circular cross-section as represented in FIG. 3,
- a rear section 14 at the stern 4, also having a circular cross-section, with a diameter that is the same as or is noticeably greater than the diameter of the front section 13,
- and, between the two, a section 15 having a D-shaped cross-section, said section 15 pressing against a wall segment 16 extending up from the deck 6, at the edge 9, along the periphery of the rigid hull 11, with the deck 6 and the edge 9 as well as the holder 5 being analogous to those of the hull 1 of FIG. 1.

This section 15 extends for a length which corresponds, for example, to at least half the total length of the boat, and is located essentially towards the back, meaning towards the stern of the boat, in the area of the deck 6 which contains the seats for example.

The section 15 may comprise a bolt rope 17 in its lower portion, as represented in FIG. 7, said bolt rope 17 being positioned for example as the extension of the bolt ropes 7, analogous to those of the boat in FIG. 1 and arranged on the sections 13 and 14, ensuring continuity with them. Similarly, the groove 18 arranged on the edge 9 of the hull 11, in the lower portion of the outer face 19 of the wall segment 16, can extend and be continuous with the groove 8, analogous to the groove of the boat in FIG. 1, and arranged in the stern and bow of said hull 11.

In the upper portion of the wall segment 16, the section 15 can comprise a supplemental band 20 forming an angle bracket, said band 20 being assembled onto the upper end of the wall segment 16 by means of a screw 21 with, for example, a metal strip 22 inserted between them.

This section 15 can consist of a single volume, as represented in FIG. 4*a*, or may comprise multiple separately inflatable volumes as represented in FIG. 4*b*.

In FIG. 4*a*, the section 15 having a D-shaped cross-section consists of a single inflatable tube having a D-shaped cross-section, directly attached and fixed, for example by gluing, by its substantially vertical flat face to the outer face 19 of the upper side wall segment 16, while its curved face is an extension of the outer portions of the front 13 and rear 14 sections of the tube 12.

In FIG. 4*b*, one of the two inflatable volumes consists of an inner substantially vertical part having an inflatable volume of $H^2P$ fabric, meaning a watertight fabric with two parallel faces, and the other one, the outer part, consists of a float having a D-shaped cross-section. Thus one obtains an inner inflatable tube 26 which when in the inflated state has a shape that is substantially parallelepipedic with a transverse cross-section that is a substantially vertically elongated rectangular form with rounded corners, directly attached, for example by gluing, to the outer face 19 of the upper side wall segment 16, by the face constituting the inner face of the two parallel faces of watertight fabric or cloth which delimit the inflatable tube 26, while the outside portion consists of an outer tube 25 having a D-shaped transverse cross-section in the inflated state, directly attached and fixed by its substantially vertical flat face to the outer surface of the inner inflatable tube 26, meaning against the face of the two parallel faces of watertight cloth or fabric of this tube 26 which constitutes its outer face.

In other words, the inflatable float of the section 15 having a D-shaped cross-section is a float consisting of two inflatable tubes, one of them an outer tube 25 having a D-shaped cross-section attached by its flat face to the flat outer face of an inner tube 26 having a substantially rectangular cross-section elongated in the vertical direction, which is itself attached by its flat inner face to the outer face 19 of the upper side wall segment 16.

An embodiment according to FIG. 4*b* with two inflatable tubes 25 and 26 forming the section 15 having a D-shaped cross-section offers the advantage of improving the impact resistance and safety of the boat. If the outer tube 25 is torn or accidentally deflated, there is still the remaining inner tube 26 which continues to provide a reduced buoyancy that is sufficient to keep the boat afloat.

FIG. 5 shows the general appearance of a tube 12 of the invention. This tube is represented in a perspective half-view. It shows the section 13 having a circular cross-section arranged at the bow 3 and the section 14 having a circular cross-section arranged at the stern 4, and between the two, the section 15 having a D-shaped cross-section establishing the continuity between sections 13 and 14.

One can also see, in the lower part of the tube 12, the bolt rope 7 for the sections 13 and 14 and the bolt rope 17 for the section 15, said bolt ropes forming a single bolt rope extending for the entire length of the three sections.

The upper part of the section 15 comprises a band 20 by which it can be attached to the upper portion of the upper side wall segment 16 of the rigid hull 1.

As a variant, instead of attaching the lower portion of the section 15 having a D-shaped cross-section by a bolt rope 17 in a groove 18 and attaching the band 20 on the upper end of this section 15 to the upper end of the upper side wall segment 16 by screws 21, with a metal strip 22 placed between them, the section 15 having a D-shaped cross-section, consisting of one or multiple inflatable tubes, can be attached at its upper part and its lower part to the upper side wall segment 16 by means of flexible angle attachments of cloth or fabric, which are glued directly to this upper side wall segment 16.

A significant increase in spaciousness is obtained for this type of boat, as one can see in FIG. 2, when compared to FIG. 1. The half-width L11 of the deck 6 at section 15 in FIG. 2 is greater than the half-width L1 of the deck 6 in FIG. 1, and the ratio of the surface areas within this zone is on the order of 30 to 40% greater for the boat according to the invention.

The invention claimed is:

1. A boat having a bow and a stern, and comprising a rigid hull associated with one or more inflatable tubes which act as upper side walls, said rigid hull having a deck, comprising two types of holder for said tube(s):

a gutter-shaped holder for receiving, at one at least of said bow and said stern, a tube section having a circular cross-section, said gutter-shaped holder being positioned substantially at the level of said deck, cooperating with a longitudinal portion of a cylindrical envelope of said tube section, a holder in the form of an upper side wall segment extending between said bow and said stern, said wall segment being arranged to cooperate with a structure in the form of an inflatable tube section which extends longitudinally between said bow and said stern, said holder in the form of a wall segment extending to a height which substantially corresponds to the diameter of at least one of said bow tube section and stern tube section and said holder in the form of a wall segment having a lateral position in which an outer face thereof is located substantially in a vertical mid-plane of at least one of said bow tube section and stern tube section, said inflatable tube section having a D-shaped cross-section with a flat face applied against an outer face of said upper side wall segment, and with a curved face located in an extension of an outer portion of at least one of said bow tube section and said stern tube section, and comprising at least two inflatable volumes, one of said inflatable volumes consisting of a substantially vertical inner inflatable tube with an inflatable volume of watertight cloth or fabric having two parallel faces, forming, in an inflated state, a tube shape with a substantially elongated rectangular cross-section, attached and fixed by an inner face to an outer face of said upper side wall segment, and an other of said inflatable volumes, forming an outer inflatable tube having a D-shaped cross-section with a flat face attached to an outer face of said inner inflatable tube.

2. The boat according to claim 1, wherein said inflatable tube section having a D-shaped cross-section is attached to a lower portion and to an upper portion of said upper side wall segment.

3. The boat according to claim 2, wherein a lower portion of said inflatable tube section having a D-shaped cross-section comprises a bolt rope which is threaded in a groove in said rigid hull, said groove being arranged in said lower portion of said upper side wall segment.

4. The boat according to claim 3, wherein said bolt rope located in said lower portion of said inflatable tube section having a D-shaped cross-section is an extension of another bolt rope of at least one of said bow and said stern tube sections, and said groove receiving said bolt rope extends for an entire length of said rigid hull.

5. The boat according to claim 2, wherein said upper portion of said inflatable tube section having a D-shaped cross-section comprises a band of fabric which is slipped into a track or bolted onto said upper portion of said upper side wall segment, with a metal strip placed between said band and said upper portion of said upper side wall segment.

6. The boat according to claim 1, wherein said inflatable tube section having a D-shaped cross-section extends, between said bow and said stern, for an inflatable tube section length corresponding to at least half the length of said boat, with a major portion of said inflatable tube section length arranged on the side of said stern.

7. The boat according to claim 1, wherein said inflatable tube section having a D-shaped cross-section consists of a single inflatable tube which is delimited by a fabric attached to said upper side wall segment and by another fabric which, in the inflated state, forms an arc that is an extension of said bow and stern tube sections.

8. The boat according to claim 1, wherein said inflatable tube or tubes is/are assembled with said upper side wall segment, to said upper portion and said lower portion of said upper side wall segment, by means of angle attachments glued directly to said upper side wall segment.

* * * * *